US005570707A

United States Patent [19]

Hill

[11] Patent Number: 5,570,707

[45] Date of Patent: Nov. 5, 1996

[54] CIGARETTE WITH FILTER

[76] Inventor: Archie S. Hill, 6511 Ste. R.D., Archdale, N.C. 27263

[21] Appl. No.: 492,403

[22] Filed: Jun. 19, 1995

[51] Int. Cl.[6] ..... A24D 3/00

[52] U.S. Cl. ..... 131/331; 131/332; 131/343

[58] Field of Search ..... 131/343, 344, 131/331, 332

[56] References Cited

U.S. PATENT DOCUMENTS

| | | | |
|---|---|---|---|
| 3,674,036 | 7/1972 | Vega | 131/7 |
| 4,379,465 | 4/1983 | Coq | 131/332 |
| 4,396,026 | 8/1983 | Grossman | 131/333 |
| 4,854,331 | 8/1989 | Banerjee et al. | 131/194 |
| 4,924,887 | 5/1990 | Raker et al. | 131/331 |
| 5,012,828 | 5/1991 | Hayes et al. | 131/341 |
| 5,105,834 | 4/1992 | Saintsing et al. | 131/334 |
| 5,246,017 | 9/1993 | Saintsing et al. | 131/335 |

*Primary Examiner*—Jennifer Bahr

[57] ABSTRACT

A filter for a cigarette is provided with a filter which includes a tacky substance which increases the filters ability to absorb particles of ash, debris and the like, thus preventing them from reaching the user. The filter may employ a heat-sensitive resinous substance such as an acrylic, butadiene styrene or the like, which will remain tacky during storage and which will assist in removing harmful particulate matter during smoking.

20 Claims, 1 Drawing Sheet

CIGARETTE WITH FILTER

BACKGROUND OF THE INVENTION

1. Field of the Invention

The invention herein pertains to cigarettes, and in particular to cigarettes which include a filter for removing particulate matter such as ash and other debris from reaching the mouth and lungs of the smoker.

2. Description of the Prior Art and Objectives of the Invention

Various filters have been used for cigarettes and other smoking articles in the past to rid the tobacco smoke of minute harmful particles or the like preventing such particles from reaching the mouth and lungs of the smoker. Certain prior art devices utilize mechanical means such as set forth in U.S. Pat. No. 3,674,036, which demonstrates a socket to catch condensate and impurities of combustion. The filter element of U.S. Pat. No. 5,246,017 presents a non-woven material of synthetic fiber construction as the filter element. U.S. Pat. No. 4,854,331 produces an aerosol "smoke" which is also virtually ashless, rather than tobacco for particulate prevention. U.S. Pat. No. 5,012,828 utilizes a filter with particulate additives absorbent material such as silica gel or activated carbon. U.S. Pat. No. 4,396,026 also demonstrates a cigarette filter having a porous substrate for trapping harmful particles. U.S. Pat. No. 4,924,887 shows a particular rod structure as used in filtering tobacco and U.S. Pat. No. 4,379,465 utilizes filters formed from a fibrous mass having thermal fusible fibers therein.

While all of the above-mentioned filters provide certain benefits, none present the advantages and objects of the invention herein as will be more fully explained below.

It is an objective of the present invention to provide a cigarette using conventional tobacco to provide the taste and enjoyment required by most smokers while including a special filter to remove particulate matter and contaminants from the smoke.

It is another objective of the present invention to provide a cigarette having an internal filter which has a tacky surface to better absorb contaminants, particulate matter and the like from the smoke which passes through.

It is yet another objective of the invention to provide a filter for a smokable article which has a tacky surface whereby the tackiness increases as it is heated from the warm smoke and heat of the burning tobacco passing thereover.

Various other objectives and advantages of the present invention will become obvious to those skilled in the art as a more detailed description is set forth below.

SUMMARY OF THE INVENTION

The invention herein pertains to a cigarette and a tacky filter therefor, the tacky filter consisting of a paper, fibrous or other conventional base and having its outer surface coated with a substance such as a resinous material such as an acrylic, vinyl acetate, styrene butadiene or the like which provides tack. In the preferred form the tacky surface is heat sensitive, in that the tackiness will increase as it receives heat from the burning tobacco and the warm smoke passing thereover.

DESCRIPTION OF THE PREFERRED EMBODIMENT

Figure 4:
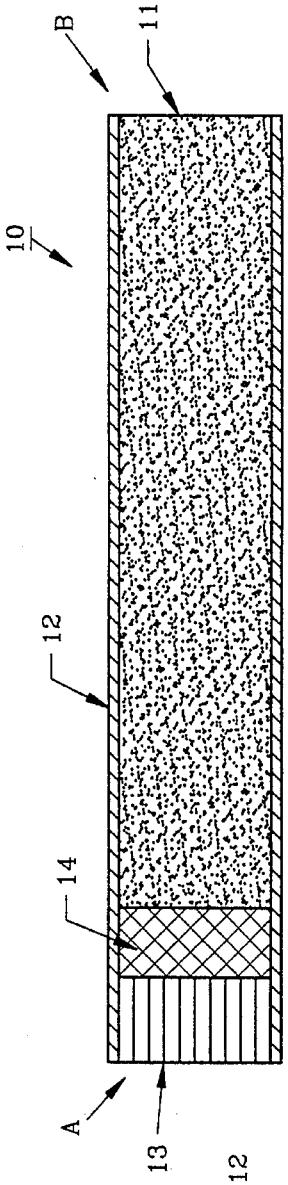
FIG. 4 shows a cross-sectional view along lines 4—4 as seen in FIG. 2.
Figure 3:
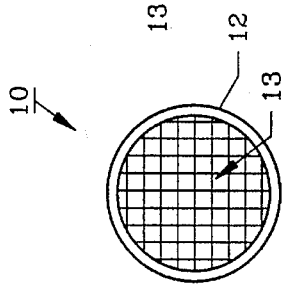
FIG. 3 demonstrates a proximal end view of the cigarette along lines 3—3 as seen in FIG. 1.

The preferred form of the invention is shown in FIGS. 1–4 which illustrates a cross-sectional view of cigarette in FIG. 4. As seen, the cigarette consists of a charge of tobacco and a conventional paper covering or wrapper with a terminal filter as is conventional in the trade. Also positioned near the proximal end of the cigarette is an internal filter between the terminal filter and the tobacco charge. The internal filter may be formed in a variety of ways and includes in its preferred form a conventional paper base or structure having a resinous coating thereon so designed to only slightly impede the smoke and air flow passing through. The resinous coating remains tacky throughout storage and use. The heat generated during smoking of the hot tobacco smoke drawn therethrough will increase the tackiness of the filter, allowing it to better trap particles of ash, and other debris. The internal filter may be constructed in any of a variety of ways to allow smoke to readily pass therethrough after coating with the preferred resinous material, an acrylic polymer as is commonly used as a non-drying one-part adhesive.

DETAILED DESCRIPTION OF THE DRAWINGS AND OPERATION OF THE INVENTION

Figure 2:
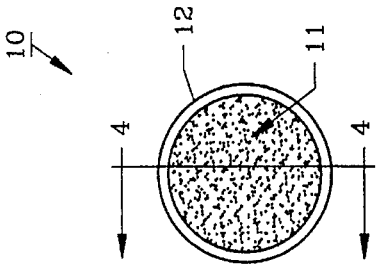
FIG. 2 shows an distal end view along lines 2—2 of FIG. 1.
Figure 1:
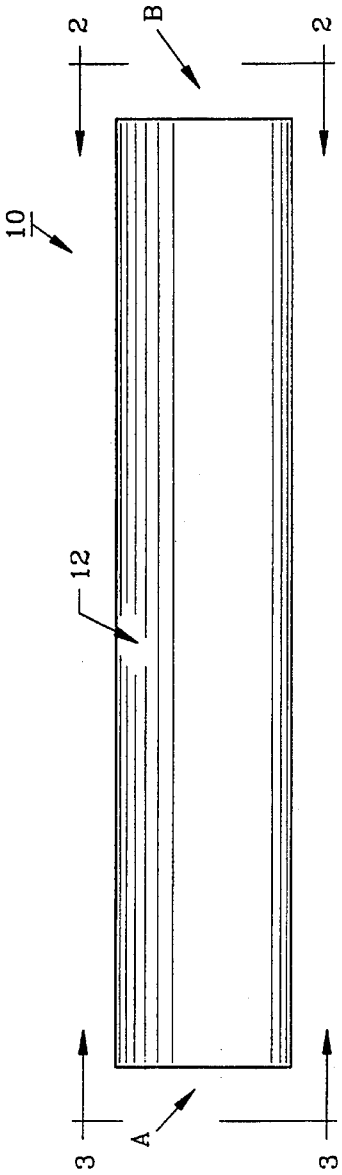
FIG. 1 demonstrate a side view of a cigarette and filter of the invention.

For a more complete understanding of the invention and its use, turning now to the drawings, FIG. 1 illustrates FIG. 10 having an outer wrapper 12 and a charge of tobacco 11, as better seen in FIGS. 2 and 4 as is conventional in the industry. Cigarette 10 a proximal end designated at A, and a distal end generally designated at B. As would be understood from FIG. 4, proximal end A is placed in the mouth during smoking and distal end B is lit. Within paper wrapper 12 at the proximal end, are two filters, conventional filter 13, as is commonly used in the trade, and internal filter 14 which, like filter 13, may be formed of cellulosic fibers, paper, synthetic fibers or otherwise, but includes a tacky substance such as an acrylic polymer as used in the adhesive industry to increase the filtering ability of internal filter 14 which will assist filter 14 in removing various particles and debris as smoke passes therethrough.

Other tacky resinous coatings may include vinyl acetate polymers, styrene butadiene polymers, ethylene vinyl acetate polymers or others which will remain tacky and preferably are heat sensitive, in that their tackiness increases due to the warm smoke passing through during smoking. Various other tacky substances may be used in conjunction with internal filter 14.

The illustrations and examples provided herein are for explanatory purposes and are not intended to limit the scope of the appended claims.

I claim:

1. A cigarette having a charge of smokable material, said cigarette comprising: an outer wrapper, said cigarette having proximal and distal ends, said smokable material disposed within said outer wrapper, a terminal filter, said terminal filter positioned at the proximal end of said outer wrapper, an internal filter, said internal filter positioned between said proximal and said distal ends within said wrapper, said internal filter comprising a tacky substance, said tacky substance maintaining its tacky characteristic throughout the storage and use of said cigarette, said tacky substance disposed on said internal filter to trap debris passing through said internal filter.

2. The cigarette of claim 1 wherein said internal filter is contiguous to said terminal filter.

3. The cigarette of claim 1 wherein said tacky filter is positioned between said smokable material and said terminal filter.

4. The cigarette of claim 1 wherein said outer wrapper is formed of paper.

5. The cigarette of claim 1 wherein said internal filter comprises paper.

6. The cigarette of claim 1 wherein said internal filter comprises a tacky substrate.

7. The cigarette of claim 1 wherein said tacky substance is heat sensitive.

8. The cigarette of claim 7 wherein said heat sensitive tacky substance comprises a resin.

9. The cigarette of claim 1 wherein said tacky substance comprises a polymeric substance.

10. The cigarette of claim 9 wherein said polymeric substance comprises an acrylic polymer.

11. The cigarette of claim 9 wherein said polymeric substance comprises an ethylene vinyl acetate polymer.

12. The cigarette of claim 9 wherein said polymeric substance comprises a styrene butadiene polymer.

13. A cigarette having proximal and distal ends and having a charge of smokable material, said cigarette comprising: a terminal filter, said terminal filter positioned at the proximal end of said cigarette, a tacky filter, said tacky filter positioned between said terminal filter and said distal end of said cigarette, said tacky filter comprising a tacky substance, said tacky substance disposed on said tacky filter to adhere particles within the smoke passing through said filter to prevent such particles from reaching the smoker, said tacky substance maintaining its tacky characteristic throughout the storage and use of said cigarette.

14. The cigarette of claim 13 wherein said tacky substance comprises an acrylic.

15. The cigarette of claim 13 wherein said tacky substance comprises ethylene vinyl acetate.

16. The cigarette of claim 13 wherein said tacky substance comprises styrene butadiene.

17. A cigarette having a charge of smokable material, said cigarette comprising: a tacky filter, said tacky filter positioned proximate said smokable material, said tacky filter comprising a tacky substance, said tacky substance disposed on said tacky filter to adhere particles within the smoke passing through said filter to prevent such particles from reaching the smoker, said tacky substance maintaining its tacky characteristic throughout the storage and use of said cigarette.

18. The cigarette of claim 17 wherein said tacky substance comprises a resin.

19. The cigarette of claim 17 wherein said tacky substance comprises a polymeric substance.

20. The cigarette of claim 17 wherein said tacky substance comprises an adhesive.

* * * * *